US006299745B1

(12) United States Patent
Kumar et al.

(10) Patent No.: US 6,299,745 B1
(45) Date of Patent: Oct. 9, 2001

(54) FLEXIBLE SUBSTRATE PLATING RACK

(75) Inventors: Raj Kumar, Mission Viejo; Cheryle Rattey, Trabuco Canyon, both of CA (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/564,081

(22) Filed: May 3, 2000

(51) Int. Cl.[7] ..... C25B 9/00

(52) U.S. Cl. ..... 204/297.01; 204/297.07; 204/279; 204/287

(58) Field of Search ..... 204/297.01, 297.07, 204/287, 279

(56) References Cited

U.S. PATENT DOCUMENTS

| | | | | |
|---|---|---|---|---|
| 4,820,396 | * | 4/1989 | de Masi | 204/297.07 |
| 4,871,436 | * | 10/1989 | den Hartog | 204/297 R |
| 5,076,903 | * | 12/1991 | Westin | 204/279 |
| 5,527,435 | * | 6/1996 | Arnau | 204/297 R |
| 6,071,388 | * | 6/2000 | Uzoh | 204/297 R |

* cited by examiner

*Primary Examiner*—Bruce F. Bell
(74) *Attorney, Agent, or Firm*—Curtis B. Brueske

(57) ABSTRACT

A rack suitable for holding a flexible substrate panel, the rack having a plurality of clamps for providing current to a panel clamped to the rack, the clamps being positioned to uniformly distribute current to the substrate. Seven clamps are used to hold a flexible substrate panel bearing a copper seed or other conductive layer in place on the rack wherein one tautens the substrate while attaching the clamps so as to clamp the substrate in a "wrinkle free" manner. The seven clamps are arranged with 3 clamps on each of the left and right sides and one clamp on the bottom, the clamps making electrical contact with conductive layers of both the front and back surfaces of the substrate panel. The arrangement of the clamps provides adequate support to the substrate, provides for a good and uniform current distribution on the substrate, and allows a relatively large amount of current to flow through the panel without burning off the conductive/seed layers. In one rack, a spring clamp biased open is used wherein a thumbscrew is tightened against a surface of the clamp to force it against its spring into a closed, clamping position. The use of the spring clamp prevents the rotating pressure point contact which a thumbscrew causes.

9 Claims, 3 Drawing Sheets

FLEXIBLE SUBSTRATE PLATING RACK

FIELD OF THE INVENTION

The field of the invention is flexible substrate plating racks.

BACKGROUND OF THE INVENTION

When electroplating a substrate it is common to attach the substrate to a rack to facilitate movement of the substrate. For a rigid substrate, the substrate is typically attached by clamping one edge of the substrate to one side of the rack. In such an instance, the rigidity of the substrate is sufficient to maintain the body of the substrate in position even though only one edge is fastened to the rack.

A common clamp used for rigid substrates is the screw-down type in which a threaded shaft acts in the manner of a set screw and is turned so that it contacts the substrate and presses the substrate against a portion of the clamp to hold it in place. Such a clamp is generally used to form an electrical connection between a conductive/seed layer on the substrate and a power source such that the seed layer acts as an electrode during electroplating.

Methods and devices for rigid substrates are generally unsuitable for use with flexible substrates. One difficulty encountered in applying rigid substrate methods to flexible substrates is that the method of clamping a rigid substrate to a substrate rack tends to damage the substrate. Another difficulty is that the current levels used for a rigid substrates tend to burn off the conductive/seed layers of a flexible substrate. Thus, there is a continuing need for new methods and devices for use in electroplating flexible substrates.

SUMMARY OF THE INVENTION

The present invention is directed to a rack suitable for holding a flexible substrate panel. A rectangular rack having seven clamps is used to hold a flexible substrate panel bearing a copper seed or other conductive layer in place wherein one tautens the substrate while attaching the clamps so as to clamp the substrate in a "wrinkle free" manner. The seven clamps are arranged with 3 clamps on each of the left and right sides and one clamp on the bottom, the clamps making electrical contact with conductive layers of both the front and back surfaces of the substrate panel. The arrangement of the clamps provides adequate support to the substrate, provides for a good and uniform current distribution on the substrate, and allows a relatively large amount of current to flow through the panel without burning off the conductive/seed layers. In one rack, a spring clamp biased open is used wherein a thumbscrew is tightened against a surface of the clamp to force it against its spring into a closed, clamping position. The use of the spring clamp prevents the rotating pressure point contact of the thumbscrew from causing damage to the conductive seed layer such as by tearing into the flexible substrate.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
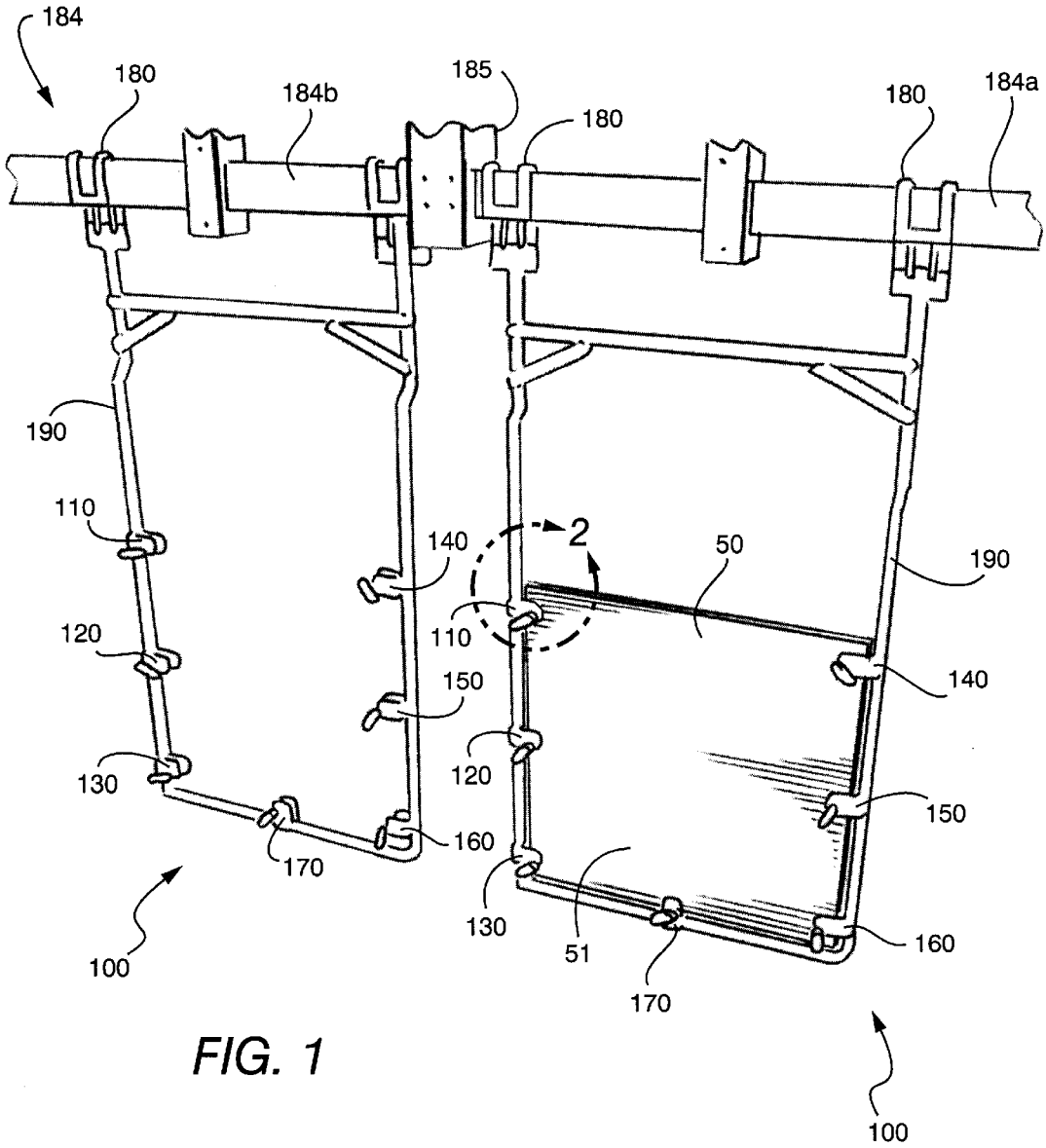
FIG. 1 is a perspective view of a first rack embodying the invention.
Figure 3:
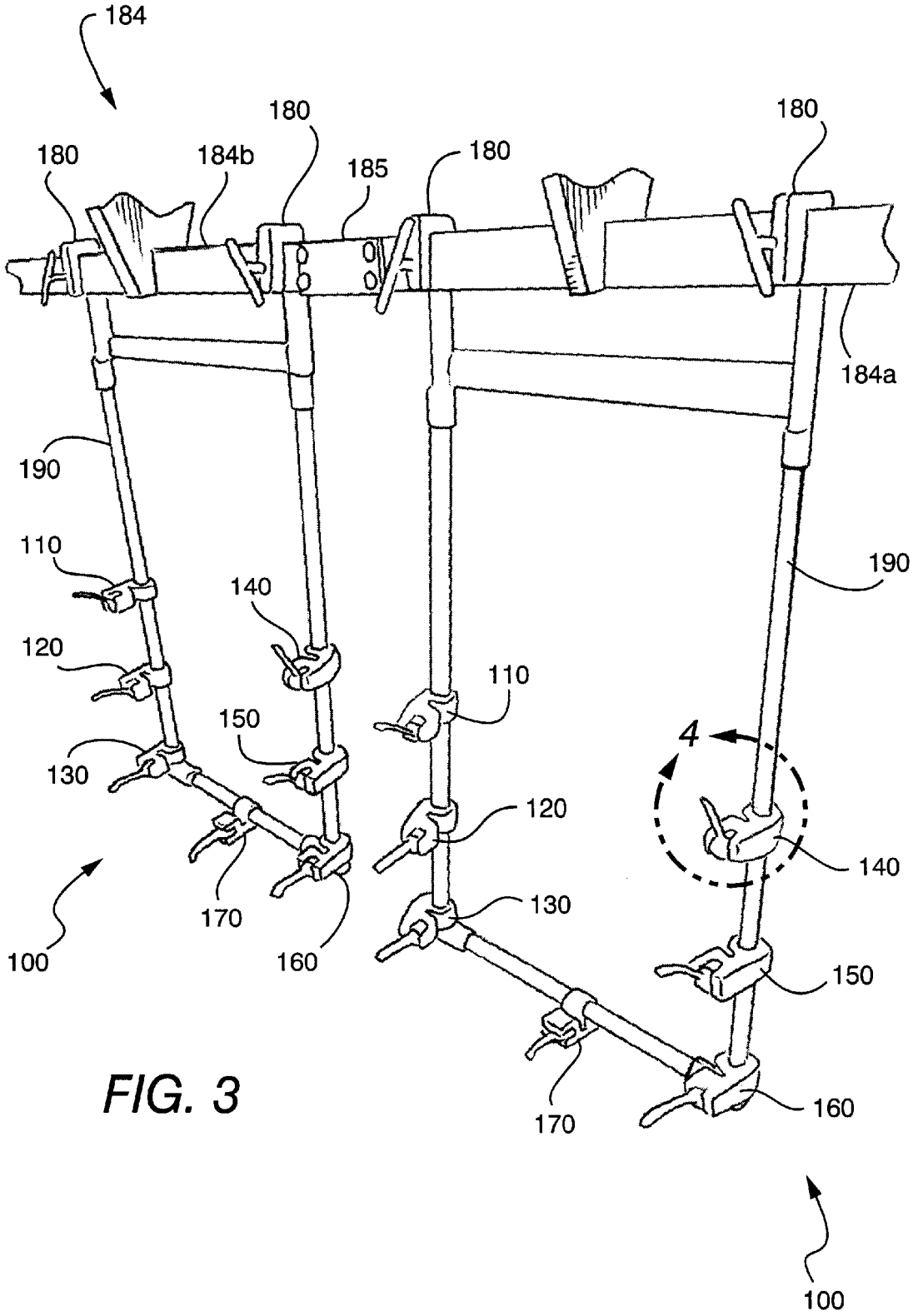
FIG. 3 is a perspective view of a second rack embodying the invention.

Referring first to FIGS. 1 and 3, a rectangular rack 100 having a frame 190 and seven clamps 110–170 is used to hold a flexible substrate panel 50 bearing a copper seed or other conductive layer 51 in place wherein one tautens the substrate 50 while attaching the clamps 110–170 so as to clamp the substrate 50 in a "wrinkle free" manner. The seven clamps 110–170 are arranged with 3 clamps (110–130 and 124–160) on each of the left and right sides and one clamp 170 on the bottom, the clamps 110–160 making electrical contact with conductive layers 51 and 52 of both the front and back surfaces of the substrate panel 50. The arrangement of the clamps 110–170 provides adequate support to the substrate 50, provides for a good and uniform current distribution on the substrate 50, and allows a relatively large amount of current to flow through the panel 50 without burning off the conductive/seed layers 51 and 52. Utilizing too few, or poorly distributed clamps with a large amount of current is likely to result in potentially damaging hot spots forming during electroplating.

Frame 190 preferably comprises a rectangular tubular frame. However, alternative embodiments may utilize frames having different shapes and dimensions. In some embodiments, the two sides (and possibly the top) of the frame may used as conductors to transfer current to claims 110–160.

Figure 2:
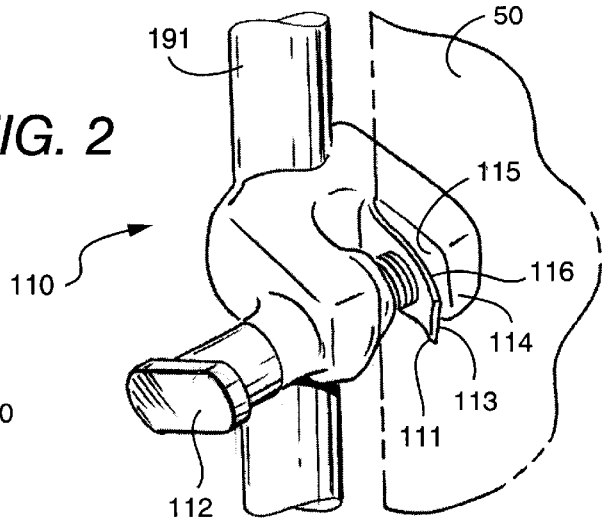
FIG. 2 is a perspective view of a clamp of the rack of FIG. 1.

Referring to the clamp 110 of FIG. 2, a spring clamp 111 comprises two jaws 113 and 114 biased open wherein a thumbscrew 112 is tightened against one moving jaw 113 to force it against its bias into a closed, clamping position wherein the substrate is sandwiched between and held by the jaws 113 and 114. The use of the thumb screw to close the spring clamp rather than having the screw itself contact the substrate prevents the rotating pressure point of the thumbscrew from damaging the substrate.

Frame 190 and substantial portions of clamps 110–170 are preferably covered by a protective, non-conductive coating to minimize plate build up on the rack 100. In preferred embodiments, it is preferred that the only uncoated portions be the conductive surface 116 of jaw 113 and the conductive surface 115 of jaw 114 which electrically contact the substrate. Conductive surface 115 is preferred to be substantially planar, fixed in position relative to frame 190, and substantially parallel to the plane formed by a substrate panel clamped into the rack.

Figure 4:
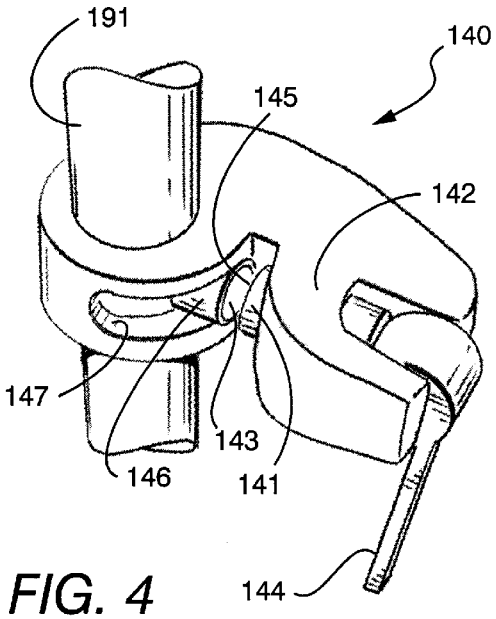
FIG. 4 is a perspective view of a clamp of the rack of FIG. 2.

Clamps 110–170 of FIGS. 3 and 4 may be substituted for the clamps of FIGS. 1 and 2. The clamps of FIGS. 3 and 4 still provide a non-rotating compression fit but provide one in which a piston 141 extends through a housing 142 to clamp substrate 50 between surfaces 145 and 143. For embodiments which will utilize vias to transfer current from one side of the substrate to the other, piston 141 and/or surface 145 need not be conductive. In embodiments wherein the clamp provides current directly to both sides of the substrate, surface 145 would be conductive and piston 141 is preferably either coated everywhere but surface 145 to prevent unwanted plating, and/or body 142 is sized and dimensioned to provide a maximum amount of coverage to piston 141 so as to minimizes the surface area of the current carrying portion/piston 141 which will come in contact with the plating solution (and thus eliminates/minimizes build up of the plate on the current carrying portion). Movement of handle 144 causes piston 141 to non-rotatably move either towards or away from the fixed surface 143. Thus, a substrate would be held in position by utilizing piston 141 and fixed surface 143 to hold the substrate in place.

The clamps of FIGS. 3 and 4 are preferred to be rotatably mounted to frame so that the clamp 140 can rotate around bar 191 of frame 190 such that post 146 acts in conjunction with slot 147 to prevent the clamp 140 from rotating more than a desired amount such as 90 degrees. It is contemplated that rotatably mounting clams 110–170 to frame 190 allows the clamps to be rotated into/out of position as a substrate is clamped or unclamped.

Although clamps 110–160 are preferred to electrically contact both of the two opposing conductive surfaces/seed layers 51 and 52 of substrate 50, alternative embodiments may electrically contact a single conductive surfaces and rely on current flow through the through holes/vias electrically connecting the two conductive surfaces together to transfer current to the conductive surface which is not electrically coupled to the clamps. Yet another alternative would be to have some of the clamps 110–160 electrically contacting one side with the remaining clamps electrically contacting the other side. In the preferred embodiment, clamp 170 does not provide current to either side but acts simply as a mechanical connection between the frame 190 and the substrate 50.

Rack 100 may also comprise mounting/fastening mechanisms 180 to couple the rack to conductive rod or bar and, via the conductive rod or bar, to a current source. Mounting mechanisms 180 are electrically coupled to clamps 110–160, either via the frame 190 or via some other current path which the rack 100 comprises. The use of thumbscrews in mounting mechanisms 180 is contemplated as being non-disadvantageous as the conductive rod/bar to which the rack is being coupled is not as likely to be damaged by a rotating compression mechanism as the substrate itself.

Figure 5:
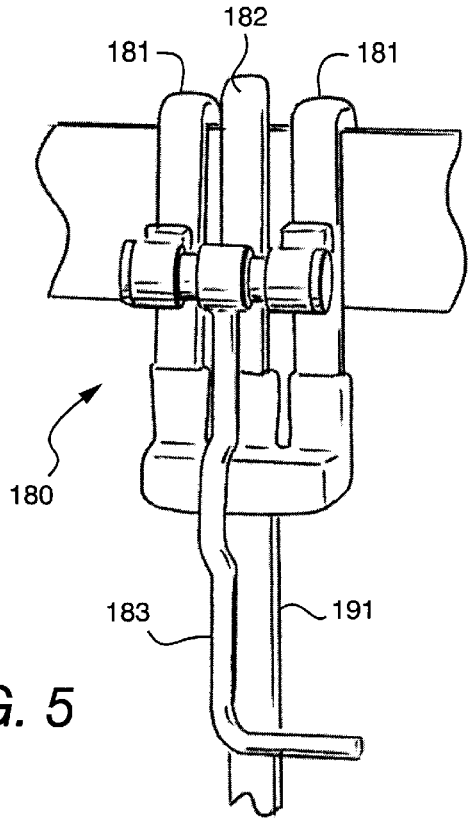
FIG. 5 is a perspective view of a mounting mechanism of the rack of FIG. 1.

Rack 100 may also comprise mounting mechanisms 180 as shown in FIGS. 1–4. Some embodiments may utilize a type of "C" clamp as shown in FIG. 3, while some might utilize the mounting mechanism of FIGS. 1 and 5. The mounting mechanism of FIGS. 1 and 5 utilize 3 arms wherein handle 183 can be used to apply pressure to arm 182 which then acts to push the substrate against arms 181.

In a preferred rack assembly, racks 100 are mechanically and electrically coupled to a split support bar 184 comprising two electrically isolated segments 184*a* and 184*b* coupled together via insulating member 185.

Thus, specific embodiments and applications of flexible substrate plating racks have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A flexible substrate plating rack for coupling a flexible substrate to a current source comprising:

a flame defining a reference plane; and a clamp for mechanically coupling a flexible substrate having a conductive surface to the rack and electrically coupling the conductive surface to a current source, the clamp being coupled to the frame, the clamp also providing a current path through which a current flowing between the current source and a substrate may flow;

wherein the clamp comprises two substrate contact surfaces with neither of the two surfaces rotating about an axis substantially perpendicular to the reference plane.

2. The rack of claim 1 wherein the rack comprises a plurality of clamps mechanically and electrically coupling the substrate to the rack, wherein each clamp provides a current path through which a current flowing between the current source and the substrate may flow.

3. The rack of claim 2 wherein the number of clamps and the positions of the clamps are such as to allow an amount of current sufficient for electroplating to flow into the conductive surface without damaging the conductive surface or the substrate or the connection between conductive surface and the substrate.

4. The rack of claim 3 wherein the rack comprises a left side and a right side, and the number of clamps positioned on the left side is equal to the number of clamps positioned on the right side.

5. The rack of claim 4 wherein at least one clamp does not provide a path for current to flow between the substrate and the current source.

6. The rack of claim 5 wherein the number of clamps is seven but only six provide current paths with the $7^{th}$ clamp providing mechanical support, but not an electrical path between the substrate and the current source, the clamps arranged with three clamps on each of two opposing sides and the seventh clamp on a side other than the two opposing sides.

7. The rack of claim 6 wherein each of the clamps further comprises a piston for pushing the substrate against a base and is rotatably mounted to the frame such that the clamp can rotate at least 90 degrees.

8. A plating rack comprising a plurality of clamps for providing current to a substrate clamped to the rack, the clamps being positioned to uniformly distribute current to the substrate.

9. The rack of claim 8 wherein the number of clamps is at least 6.

* * * * *

UNITED STATES PATENT AND TRADEMARK OFFICE

CERTIFICATE OF CORRECTION

PATENT NO. : 6,299,745 B1
DATED : October 9, 2001
INVENTOR(S) : Kumar et al.

It is certified that error appears in the above-identified patent and that said Letters Patent is hereby corrected as shown below:

Column 4,
Line 12, replace “flame” with -- frame --.

Signed and Sealed this

Seventeenth Day of September, 2002

*Attest:*

*Attesting Officer*

JAMES E. ROGAN
*Director of the United States Patent and Trademark Office*